US008449270B2

(12) United States Patent
Washko

(10) Patent No.: US 8,449,270 B2
(45) Date of Patent: May 28, 2013

(54) HYDRAULIC POWERTRAIN SYSTEM

(76) Inventor: Frank Michael Washko, Pacifica, CA (US)

( * ) Notice: Subject to any disclaimer, the term of this patent is extended or adjusted under 35 U.S.C. 154(b) by 913 days.

(21) Appl. No.: 12/416,854

(22) Filed: Apr. 1, 2009

(65) Prior Publication Data

US 2009/0250035 A1 Oct. 8, 2009

Related U.S. Application Data

(60) Provisional application No. 61/041,917, filed on Apr. 2, 2008.

(51) Int. Cl.
*F04D 1/00* (2006.01)

(52) U.S. Cl.
USPC ..... 417/364; 123/197.1

(58) Field of Classification Search
USPC ..... 123/197.1; 417/364
See application file for complete search history.

(56) References Cited

U.S. PATENT DOCUMENTS

| | | | |
|---|---|---|---|
| 1,144,921 | A | 6/1915 | Stever |
| 2,091,411 | A | 8/1937 | Mallory |
| 2,658,486 | A | 11/1953 | De Waide |
| 3,010,440 | A | 11/1961 | Roth |
| 3,139,837 | A | 7/1964 | Yissar |
| 3,610,215 | A | 10/1971 | Carter |
| 3,815,555 | A | 6/1974 | Tubeuf |
| 3,998,049 | A | 12/1976 | McKinley et al. |
| 4,040,772 | A | 8/1977 | Caldarelli |
| 4,115,037 | A | 9/1978 | Butler |
| 4,326,380 | A | 4/1982 | Rittmaster et al. |
| 4,382,748 | A | 5/1983 | Vanderlaan |
| 4,435,133 | A | 3/1984 | Meulendyk |
| 4,599,861 | A | 7/1986 | Beaumont |
| 4,606,708 | A | 8/1986 | Clark |
| 4,674,280 | A | 6/1987 | Stuhr |
| 5,072,589 | A | 12/1991 | Schmitz |
| 5,127,369 | A | 7/1992 | Goldshtik |
| 5,203,680 | A | 4/1993 | Waldrop |
| 5,261,797 | A | 11/1993 | Christenson |
| 5,461,861 | A | 10/1995 | Wenzel |
| 5,556,262 | A | 9/1996 | Achten et al. |
| 5,623,894 | A | 4/1997 | Clarke |
| 5,647,734 | A | 7/1997 | Milleron |
| 5,702,238 | A | 12/1997 | Simmons et al. |
| 5,799,636 | A | 9/1998 | Fish |
| 5,829,393 | A | 11/1998 | Achten et al. |
| 5,950,579 | A | 9/1999 | Ott |
| 5,992,356 | A | 11/1999 | Howell-Smith |
| 6,058,901 | A | 5/2000 | Lee |

(Continued)

OTHER PUBLICATIONS

C.D. West, Stirling Engines and Irrigation Pumping, Oak Ridge National Laboratory, ORNL/TM-10475, Sep. 8, 1987.

(Continued)

*Primary Examiner* — Anh Mai
*Assistant Examiner* — Brenitra M Lee
(74) *Attorney, Agent, or Firm* — Frank M. Washko

(57) ABSTRACT

A hydraulic powertrain system is disclosed, in which one possible embodiment provides at least one combustion cylinder, at least one cylinder head, at least one piston. During combustion, pressure moves the piston downwards, where it creates motion in an attached hydraulic cylinder. Fluid in the hydraulic cylinder is then pressurized, where it exits the hydraulic cylinder and is directed to a fluid turbine, where work is extracted from the pressurized fluid.

20 Claims, 8 Drawing Sheets

U.S. PATENT DOCUMENTS

| | | | | |
|---|---|---|---|---|
| 6,112,522 | A | 9/2000 | Wright | |
| 6,202,416 | B1 | 3/2001 | Gray, Jr. | |
| 6,230,671 | B1 | 5/2001 | Achterberg | |
| 6,318,309 | B1 | 11/2001 | Burrahm et al. | |
| 6,551,076 | B2 | 4/2003 | Boulware | |
| 6,609,371 | B2 | 8/2003 | Scuderi | |
| 6,668,769 | B1 | 12/2003 | Palazzolo | |
| 6,722,127 | B2 | 4/2004 | Scuderi et al. | |
| 6,752,104 | B2 | 6/2004 | Fiveland et al. | |
| 6,752,133 | B2 | 6/2004 | Arnell | |
| 7,191,738 | B2 | 3/2007 | Shkolnik | |
| 7,350,483 | B2 | 4/2008 | Atkins, Sr. | |
| 2006/0048728 | A1* | 3/2006 | Scalzo | 123/53.1 |
| 2007/0079805 | A1* | 4/2007 | Weber et al. | 123/348 |
| 2008/0141973 | A1 | 6/2008 | Shkolnik et al. | |
| 2009/0205886 | A1* | 8/2009 | Supina et al. | 180/65.22 |

OTHER PUBLICATIONS

N. Shkolnik and A. Shkolnik, High Efficiency Hybrid Cycle Engine, ASME Internal Combustion Engine Division 2005, Proceedings of ICEF2005, ICEF2005-1221, Sep. 2005.

* cited by examiner

HYDRAULIC POWERTRAIN SYSTEM

CROSS-REFERENCE TO RELATED APPLICATIONS

This application claims priority benefit of U.S. Provisional Patent Application No. 61/041,917, entitled "Hydraulic Powertrain System," filed Apr. 2, 2008. The disclosure in that application is incorporated herein in its entirety.

BACKGROUND

The present invention relates generally to powertrain systems, and more specifically, to internal combustion engines.

A wide variety of reciprocating and rotating internal combustion engine designs currently exist. The most common is the four-stroke reciprocating engine, such as those used with Otto and Diesel cycles. There are various disadvantages of these designs. Significant weight is required for components such as the crankshaft and deep skirt of the block. The geometry of the engine, such as the stroke and valve events, is generally fixed, which is leads to compromised performance and efficiency over the range of operating speeds. A design typically works only with a specific type of fuel. Also, the design is large and space-consuming, because the components must be placed in specific relationship to each other. There are other disadvantages not detailed here.

The present invention addresses these problems, and others. An internal combustion engine design is used that eliminates the connecting rods, crankshaft, and lower block of the engine, and replaces them with a hydraulic cylinder. The hydraulic cylinder can raise and lower the piston. High pressure fluid can be released from hydraulic cylinder when the piston acts downward on the hydraulic cylinder during a power stroke, sending the pressurized fluid to a fluid power device.

In an exemplary embodiment of the powertrain system, the engine piston mates to a hydraulic cylinder. Hydraulic valves precisely control the upward and downward movement of the hydraulic cylinder. The high pressure fluid produced by the hydraulic cylinder during a power stoke is sent to a fluid power device. One example of a fluid power device is a fluid turbine. In yet another exemplary embodiment of the present invention, the fluid turbine may be mated to an electric power generating and storing device, such as an integrated starter generator. Other advantages, features, and embodiments are described below.

DETAILED DESCRIPTION

While the exemplary embodiments illustrated herein may show the various features, it will be understood that the features disclosed herein can be combined variously to achieve the objectives of the present invention.

Briefly, the system disclosed herein mates a power generation device to a hydraulic motion device to generate pressurized fluid to transfer energy. Different embodiments could use various power generation devices, such as an internal combustion engine, an electric motor, an actuator, or any other power generation device. The first embodiment disclosed herein replaces the rotating assembly of the internal combustion engine with a precision hydraulic actuator and fluid turbine. Instead of a rotating crankshaft producing shaft work, a hydraulic motion device is used to compress the working fluid and then to transmit power into a hydraulic system for work output. However, the power generation devices disclosed herein could be replaced with an electric motor or other such device and still achieve works at the fluid turbine. For the purposes of this application, "fluid" can mean any liquid, gas, mixed-flow, or other reasonable medium that transmits energy or momentum.

Figure 1:
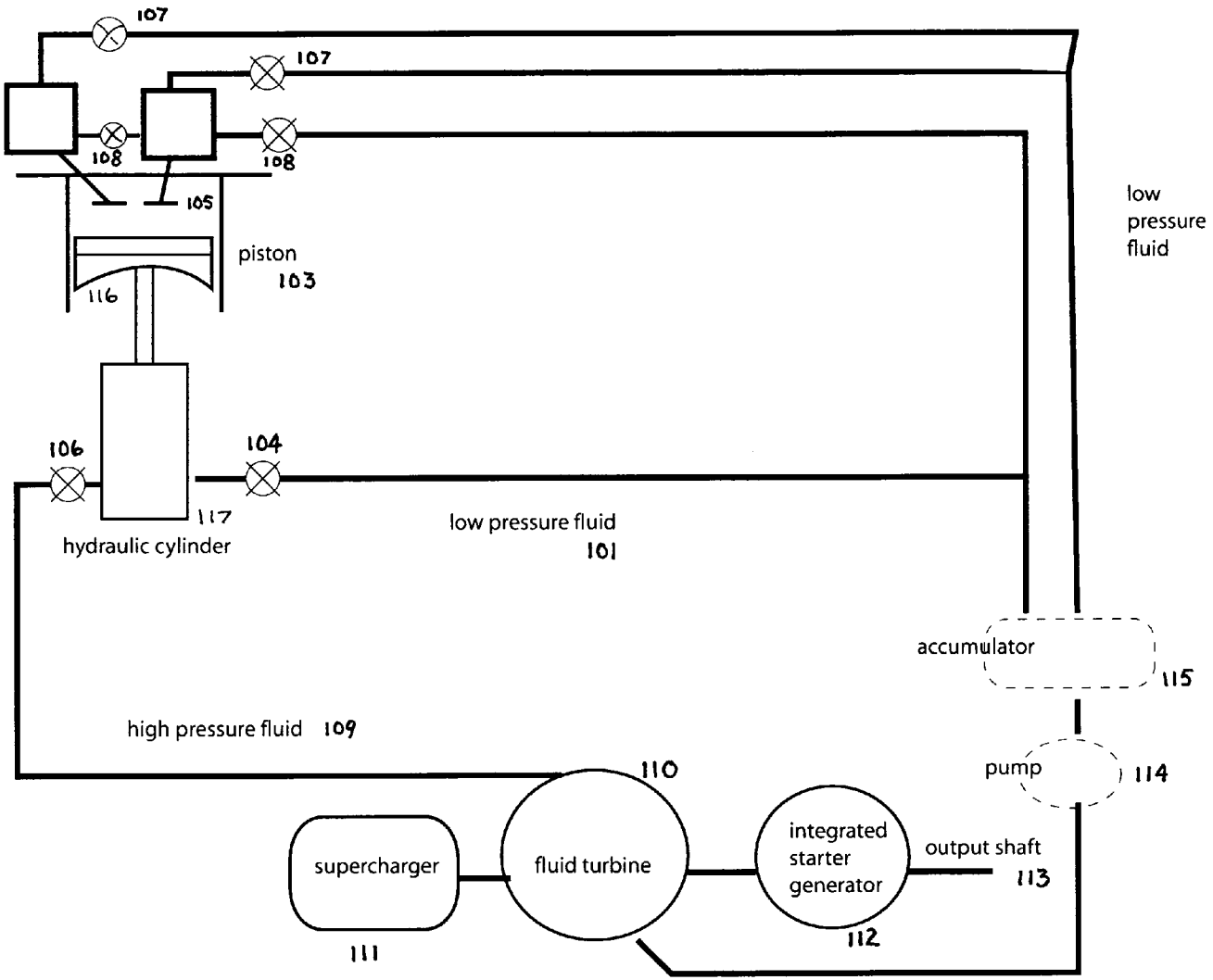
FIG. 1 shows a schematic diagram of one embodiment of the hydraulic powertrain system.

One embodiment of the system is shown in FIG. 1. The figure shows a combustion cylinder 116, piston 103, and cylinder head. The cylinder head is an assembly of a number of structural and valvetrain components, and may include valves 105. A cylinder head may include any number of different traditional or advanced valvetrain systems. The space between the piston 103 and the cylinder head in the combustion cylinder 116 is a combustion chamber, where an air-fuel mixture may be burned and combustion takes place. The traditional connecting rod, crankshaft, bearings, and flywheel/flex plate have all been replaced by a combined hydraulic actuator and power cylinder.

A hydraulic motion device 117 is attached to the bottom of the combustion cylinder 116, and the piston 103 can be attached to the hydraulic motion device 117. The hydraulic motion device may be any one of a variety of devices, including linear and rotational hydraulic actuators, among other devices. A rotary arrangement could be used with a radial arrangement of combustion cylinders. For example, the piston and connecting rod could push downward on an offset crankpin, similar to a traditional engine, that would rotate a radial hydraulic actuator, and pressurize fluid inside, like the rotational work on a pump. In the present embodiment, however, the hydraulic motion device 117 can be a linear hydraulic cylinder, which is a piston in a cylinder, wherein the piston moves as pressurized fluid is injected into one end of the cylinder to raise the piston, or the other end to lower it.

In this embodiment, the reciprocating action of the piston 103 is supplied by the hydraulic cylinder 117. The system opens an inlet hydraulic valve 104 to allow fluid to push the piston upwards and compress the fuel/air mixture. On the power stroke, where pressurized combustion gas pushes piston 103 downward, the inlet hydraulic valve 104 is closed and the outlet hydraulic valve 106 is opened, pushing fluid out of the hydraulic cylinder 117. The valves 103 and 104 may be selectively opened and closed versus time to control piston 103 position, to control the compression ratio of the engine, or potentially to control compression and expansion versus time—and shape the P-V work diagram. The relatively low pressure input lines 101 may feed fluid to the hydraulic cylinder to raise the piston 103 against the fuel-air mixture. The resulting downward motion of the piston 103 during its power stroke compresses the hydraulic cylinder 117, delivering relatively high pressure fluid 109 to a fluid turbine 110 for work.

The hydraulic lines, such as 101 and 109, could be hard lines, flexible lines, or any other technology for transmitting fluid.

The progression of the operation of this embodiment, for a four-cycle internal combustion engine, may be as follows: at the compression stroke, the electrohydraulic valve 104 on the inlet side of the opened to allow relatively low pressure hydraulic fluid 101 to enter the hydraulic cylinder 117 and raise the piston, thus compressing the fuel-air mixture.

Upon ignition, the inlet hydraulic valve 104 is closed, and the electrohydraulic valve on the outlet side of the hydraulic cylinder 106 is opened. As the piston 103 travels downward with high speed and pressure, the fluid in the cylinder is forced out of the cylinder 117 into the high pressure side of the hydraulic circuit 109. In essence, the downward stoke of the piston is used to pump relatively high pressure fluid into a hydraulic turbine 110. The outlet of the turbine 110, in turn, could be used to supply relatively low pressure fluid 101 as part of its work product, after the fluid has done work in the turbine 110. Alternatively, the fluid could simply exit the system or be stored elsewhere. The circuit may then be repeated to achieve reciprocating motion of the piston and to generate constant rotating work in the fluid turbine.

In another embodiment, a branch of the low pressure fluid 101 could also used to actuate an electro-hydraulic valvetrain system 105. In this system, pressurized fluid is allowed into an electro hydraulic valve 107, to push engine valves 105 open. When the valves 105 are desired to be closed, the inlet valves 107 may be closed, and fluid exit valves 108 are opened to exhaust the fluid from the system. It is important to note that there are a variety of hydraulic valvetrain systems that could be used in conjunction with the hydraulic powertrain system, and this is just one variety. In another embodiment, the fluid for the electrohydraulic valvetrain system could be supplied from the high pressure fluid 109 side of the system. In yet other embodiments, the hydraulic powertrain system could use traditional mechanical valves or electric valves.

It is also important to note that there are a wide variety of different hydraulic circuits that could be used in the spirit of the present invention. Different high pressure or low pressure circuits, different routings, multiple circuits, pressure control devices, pumps 114, pressure accumulators 115, bubble extractors, or other fluid systems could be inserted into the system while keeping with the objective of a fluid system that supplies fluid to a fluid motion device and extracts work from pressurized fluid.

It may also be necessary, from an efficiency standpoint, to have separate hydraulic circuits to push the piston up and a separate circuit to lower the piston. Additionally, the simplest system would use residual pressure from the fluid turbine to power the hydraulic circuit and the piston motion. However, there may ultimately be a need for a small secondary pump 114, or several pressure accumulators 115 to ensure uninterrupted operation of the system. It may be possible do without an external pump by "tuning" the low-side pressure and high-side pressures required, the size of the hydraulic cylinder, and the flow rates and pressures of the fluid turbine during the development phase.

An internal combustion engine thermodynamic cycle is, in large part, a function of the geometrical design constraints that are set in the engine design. If the piston motion and valves can be operated independently of any mechanical constraints, any thermodynamic cycle can be specified by the operator.

To control the P-V diagram, or thermodynamic work cycle to achieve greater efficiency. Compression and expansion can be optimized for more work per cycle. In a standard engine, the cycle is fixed because the piston must always follow the same periodic motion dictated by the crankpin motion. Here, we can raise or lower the piston any way we desire by controlling the flow rate in and out of the hydraulic cylinder.) the compression stroke to achieve desired cycles. Possible cycles achievable include not only Otto, Diesel, Miller, or Atkinson cycles, but also more exotic cycles such as OttoDiesel (HCCI), and ideal work cycles not achievable with a standard engine. More importantly, these cycles may be achieved on the same engine at the push of a button. A microcontroller may be used to control the engine and the hydraulic system, and a user interface may be used to change the duty cycle, such as: efficiency, performance, highway/city, fuel, cycle, or other cycles. This would change of the control strategy of the hydraulic valves. In addition, the hydraulic powertrain system could be combined with any other engine technology known in the art, such as direct injection, boosting technologies 111, hybrid electric systems 112, variable valvetrains, or any other system.

Similarly, control over the piston movement and compression ratio then allows flexible fuel operation. The main impediment to flexible fuel operation in current engines is the requirement to change the calibration, valve timing, and compression ratio to operate different fuels efficiently. A calibration is simple enough to change. However, in a fixed-geometry engine, the other features are more difficult to change. Another significant benefit of the hydraulic cylinder concept is that it allows the engine controller to be programmed to operate with a variable piston stroke, compression ratio, compression/expansion cycle, valve timing, and calibration—all with the push of a button on the calibration controller.

Correspondingly, one engine design using our concept can run any fuel: gasoline of any octane or mixture, ethanol, natural gas, Diesel No. 2, biodiesel blends, JP8 (and similar), or even hydrogen. A separate control strategy can be preprogrammed into the controller such that an engine can be changed from gasoline to diesel operation with the push of a button—along with a change in injector, igniter, and a fuel system flush.

Figure 2:
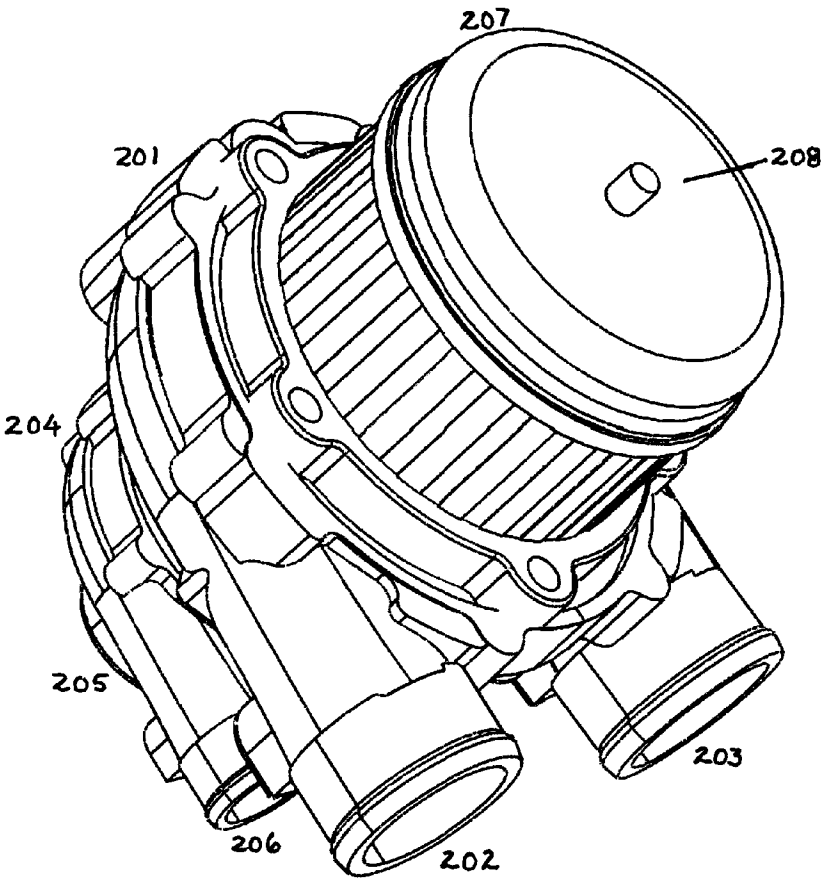
FIG. 2 shows an embodiment of the fluid power unit, with additional components and features.

Turning to FIG. 2, this figure shows the fluid power unit, with optional accessories. The fluid power device 201 is designed to take pressurized fluid and generate power from it. This device can be a fluid turbine, impeller, or any other device that generates power from a pressurized fluid that enters through the fluid entry 201 and exits through the fluid exit 202. It may also be desirable to attach a supercharger 204 to the fluid power unit. In a supercharger, the central shaft from the fluid power device 201 can be used to rotate a shaft in the supercharger 204, which would draw air into the supercharger 205 and expel pressurized air from exit 206. The pressurized air would boost the output of the hydraulic powertrain. Alternatively, a supercharger or turbocharger can be used that is separate from the fluid power device 201, or none may be used at all.

In addition, part of a hybrid power subsystem can be attached to the fluid power device 201. An example is an integrated starter-generator 207 that is used with batteries, which can take excess power from the fluid power device 201 and store the power in batteries. Alternatively, power from the batteries could be input to the integrated starter-generator to ultimately increase the final output of the system at shaft 208.

Figure 3:
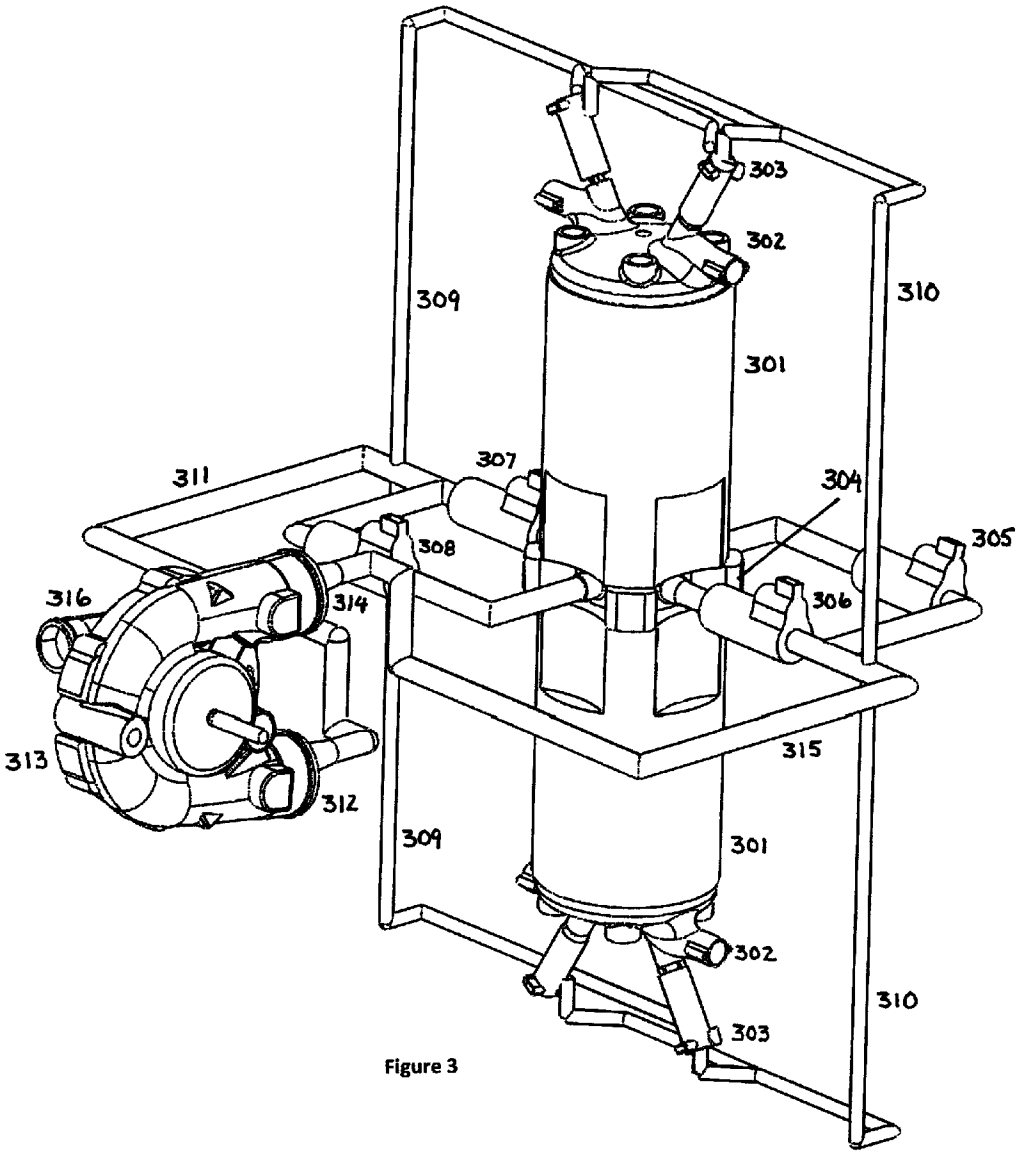
FIG. 3 shows an embodiment of a two-cylinder design of the hydraulic powertrain system.

Turning to FIG. 3, another embodiment is illustrated. In this embodiment, two combustion cylinders 301 are arranged 180 degrees apart, with a shared hydraulic cylinder 304 between them. This requires the use of four inlets into the hydraulic cylinder: one to raise the cylinder on the low pressure side, one to lower the piston the low pressure side, one to expel high pressure fluid when the cylinder is moving down, and one to expel high pressure fluid when the cylinder is moving up.

The progression of the operation of this embodiment, for a four-cycle internal combustion engine, may be as follows: at the compression stroke of the top cylinder, low pressure fluid 315 is supplied. The electrohydraulic valve 306 on the inlet side of the hydraulic cylinder is opened to allow relatively low pressure hydraulic fluid 315 to enter the hydraulic cylinder 304 and raise the piston in the top cylinder 301, thus compressing the fuel-air mixture.

A benefit of the system is that, simultaneously, the lower cylinder 301 is operating at a different point in the four stroke cycle. While the top cylinder is compressing and drawing fluid in through valve 306, high pressure fluid in the other side of the hydraulic cylinder 304 is expelled through 307. The power stroke of the lower cylinder expels the high pressure fluid through valve 307 into the high pressure line 311.

At the next stage of the four cycles, the top cylinder 301 is in the power stroke, and the lower cylinder 301 is in the exhaust stroke. The hydraulic cylinder 304 is moving downwards. Hydraulic valves 306 and 307 are closed. High pressure electrohydraulic valve 308 is opened so the pressurized fluid can be expelled from the piston being forced down from the top cylinder power stroke. At the same time, valve 305 is opened so that low pressure fluid can be drawn into the top side of the hydraulic cylinder to replace the fluid previously expelled through valve 307.

At the third stage of the four cycles, the top cylinder 301 is in the exhaust stroke, and the lower cylinder 301 is in the intake stroke. At this stage, the hydraulic cylinder 304 is moving up. Hydraulic valves 308 and 305 are closed. Pressurized fluid is expelled through valve 307, which is opened while the piston moves upwards. Low pressure fluid is drawn in through valve 306, which is opened to all fluid to replace the fluid expelled through valve 307.

At the final stage of the four cycles, the top cylinder 301 is in the intake stroke, and the bottom cylinder 301 is in the compression stroke. Valve 308 is opened to allow high pressure fluid to exit the bottom of hydraulic cylinder 304, and valve 305 is opened to allow fluid to enter the top of the hydraulic cylinder to replace the fluid expelled in the last stage.

Next, the cycles are repeated, with the next stage being the compression stroke in the top cylinder and the power stroke in the lower cylinder. An advantage is that there are at least two high pressure ejections of fluid per four cycles that are sent to the fluid turbine 313, and that the power stoke of the lower cylinder 301 assists with the compression of the upper cylinder 301.

The high pressure line 311 feeds fluid to the high pressure entrance to the fluid turbine 312, where work is done in the hydraulic power device 313. After work is extracted from the fluid, it exits at low pressure exit 314. In this embodiment, the low pressure fluid circulates back into the system at 315.

In addition the high pressure lines 309 feed high pressure fluid into the electrohydraulic valves 303 on the heads 302 to open the engine valves. To close the valves, low pressure fluid is then released into low pressure lines 310. An optional supercharger 316 is shown coupled to the turbine.

Figure 4:
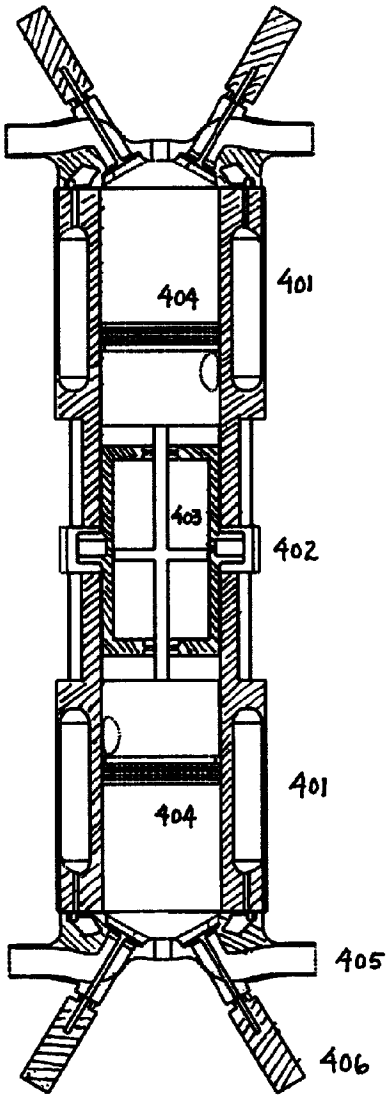
FIG. 4 shows a section view of the cylinders of the two-cylinder design in FIG. 3.

Turning to FIG. 4, a section view of the two-cylinder embodiment is show. The hydraulic cylinder 402 is sandwiched between the two cylinders 401. The hydraulic cylinder piston 403 rests inside the hydraulic cylinder 402, where it alternately pushes fluid in and out of the top and bottom reservoirs of the hydraulic cylinder as it moves. It also alternately moves the engine pistons 404 up and down as it moves.

Figure 5:
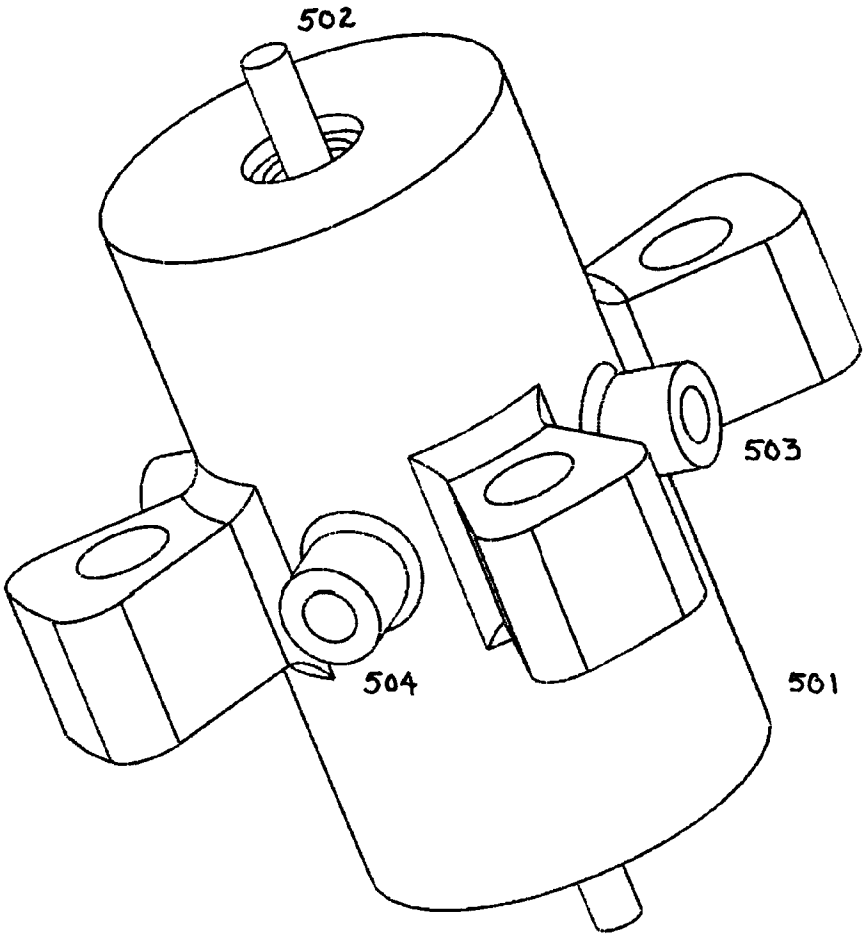
FIG. 5 shows the hydraulic cylinder used in the embodiment of FIG. 3.

Turning to FIG. 5, this is an embodiment of the hydraulic motion device, shown here as a hydraulic cylinder 501. The piston 502 is shown inside the cylinder with two shafts exiting each side of the hydraulic cylinder 501. The figure shows a low pressure inlet at 503 and a high pressure exit at 504. There may be four inlets or outlets around the perimeter of the cylinder. One may be used as a low pressure fluid entry to push the piston up, while another may be a low pressure fluid entry to push the cylinder down. One may be used as a high pressure exit when the piston is moving downwards while the other is a high pressure exit when the piston is moving up. Also, the hydraulic motion device, or hydraulic cylinder, likely includes an electronic means for measuring piston displacement and velocity, such as a linear encoder, or any other device for measuring displacements.

Figure 6:
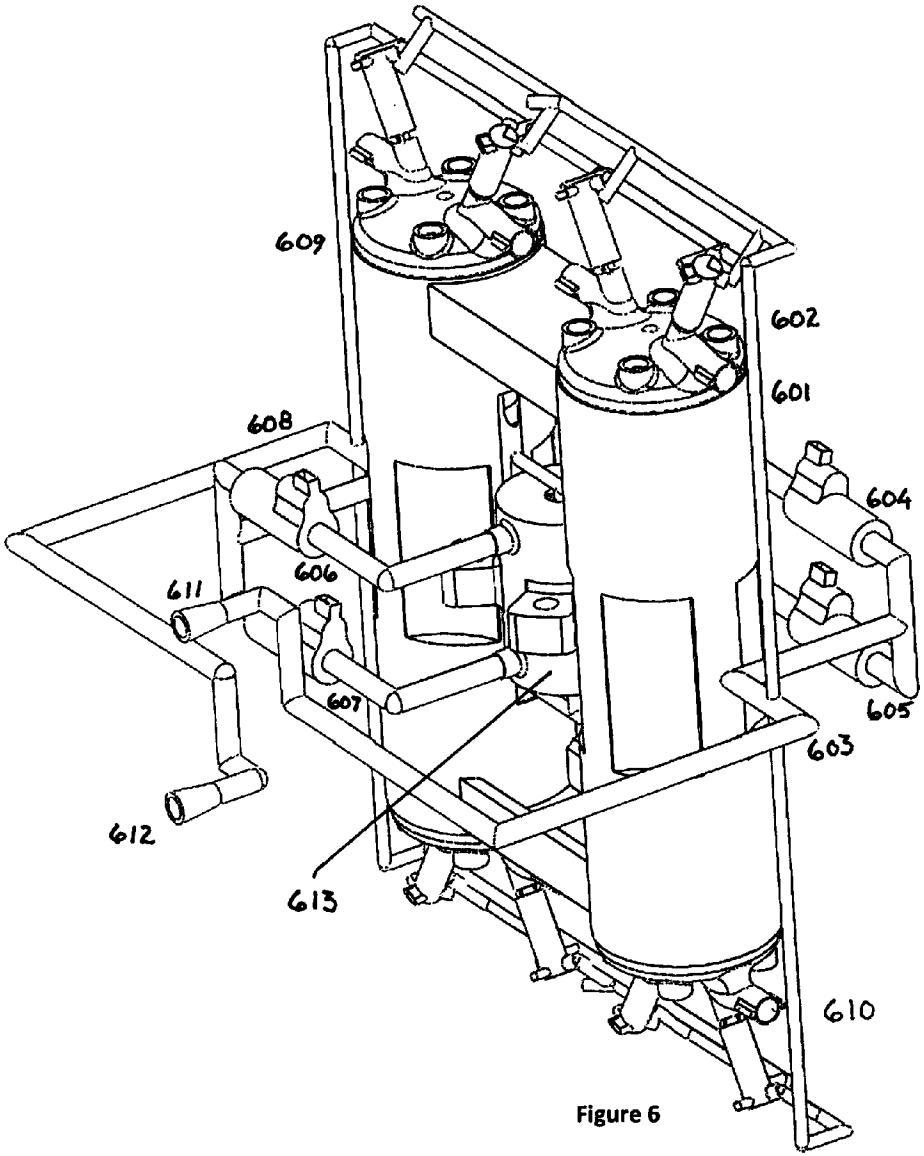
FIG. 6 shows an embodiment of a four-cylinder design of the hydraulic powertrain system.

Yet another embodiment is shown in FIG. 6. This is a four combustion cylinder 601 design, with the cylinders in an H-pattern. The hydraulic cylinder 613 sits in the middle of the H, and the piston is attached to each of the four pistons, so they reciprocate up and down with the movement of the piston in the hydraulic cylinder 613.

The progression of the operation of this embodiment, for a four-cycle internal combustion engine, may be as follows: at the compression stroke of the top left cylinder, low pressure fluid 603 is supplied. The electrohydraulic valve 604 on the inlet side of the hydraulic cylinder is opened to allow relatively low pressure hydraulic fluid 603 to enter the hydraulic cylinder 613 and raise the piston in the top left cylinder 601, thus compressing the fuel-air mixture in the top left cylinder.

A benefit of the system is that, simultaneously, the other three cylinders 601 are operating at different points in the four stroke cycle. While the top cylinder is compressing and drawing fluid in through valve 604, high pressure fluid in the other side of the hydraulic cylinder 607 is expelled through 608. The power stroke of the lower right cylinder 601 expels the high pressure fluid through valve 607 into the high pressure line 608. At the same time, the lower right cylinder is at its intake stroke, and the upper right cylinder is at its exhaust stroke, so every cylinder in the H patter is in balance and at a different stage of the four-stroke cycle.

At the next stage of the four cycles, the top right cylinder 601 is in the power stroke, the lower right cylinder 601 is in the exhaust stroke, the lower left cylinder 601 is in the compression stroke, and the upper right cylinder 601 is in the intake stroke. The hydraulic cylinder 613 is moving downwards. Hydraulic valves 604 and 607 are closed. High pressure electrohydraulic valve 606 is opened so the pressurized fluid can be expelled from the piston being forced down from the top left cylinder power stroke. At the same time, valve 605 is opened so that low pressure fluid can be drawn into the top side of the hydraulic cylinder to replace the fluid previously expelled through valve 607.

At the third stage of the four cycles, the top left cylinder 601 is in the exhaust stroke, the lower right cylinder 601 is in the intake stroke, the lower left cylinder 601 is in its power stroke, and the upper right cylinder is in its compression stroke. At this stage, the hydraulic cylinder 613 is moving up. Hydraulic valves 605 and 606 are closed. Pressurized fluid is expelled through valve 607, which is opened while the piston moves upwards. Low pressure fluid is drawn in through valve 304, which is opened to all fluid to replace the fluid expelled through valve 606.

At the final stage of the four cycles, the top left cylinder 601 is in the intake stroke, the bottom right cylinder 601 is in the compression stroke, the bottom left cylinder 601 is in its exhaust stroke, and the upper right cylinder 601 is in its power stroke. Valve 606 is opened to allow high pressure fluid to exit the bottom of hydraulic cylinder 613, and valve 605 is opened to allow fluid to enter the top of the hydraulic cylinder to replace the fluid expelled in the last stage.

There are a number of advantages to this arrangement. First, there are four high pressure fluid ejections over four cycles—one per movement of the cylinder. This is a high output and compact version of the design. Second, while work from the low pressure fluid may normally be required for the compression stage of a cylinder, in this design, one cylinder is always in its power stroke. Therefore, the power stroke of one cylinder is always helping to compress another cylinder. Less work is required from the low pressure fluid to operate the hydraulic powertrain system. Finally, a wide variety of cylinder patterns, arrangements, and quantities could be used within the spirit of the invention. In fact, any number of cylinders could be stacked and connected in series or parallel to possibly increase the overall output of the system.

In addition, the high pressure lines 609 in this embodiment are used to supply pressurized fluid to the electrohydraulic valvetrain 602. Return fluid from the valvetrain exits at low pressure lines 610, although there are a variety of different routings possible. The electrohydraulic valvetrain could also be placed on its own separate fluid cycle with or without a pump, or a traditional valvetrain could be used. The high pressure exit to the fluid power device 612 is shown, and the low pressure fluid entry is shown at 611.

It is important to note that the terms 'low' pressure and 'high' pressure are relative, and any different combinations of pressures could be used. For example, in yet another embodiment, relatively high pressure fluid could be used at the hydraulic cylinder inlets, while relatively lower pressure could be forced out of the hydraulic cylinder, while still 'high' enough to provide useful work. Therefore, the pressures at each point in the hydraulic powertrain system could be modified and tuned to suit any particular need or application. In yet another embodiment, separate hydraulic circuits could be used on each side of the hydraulic cylinder—one to raise the piston and one where expelled fluid is used to create work.

Figure 7:
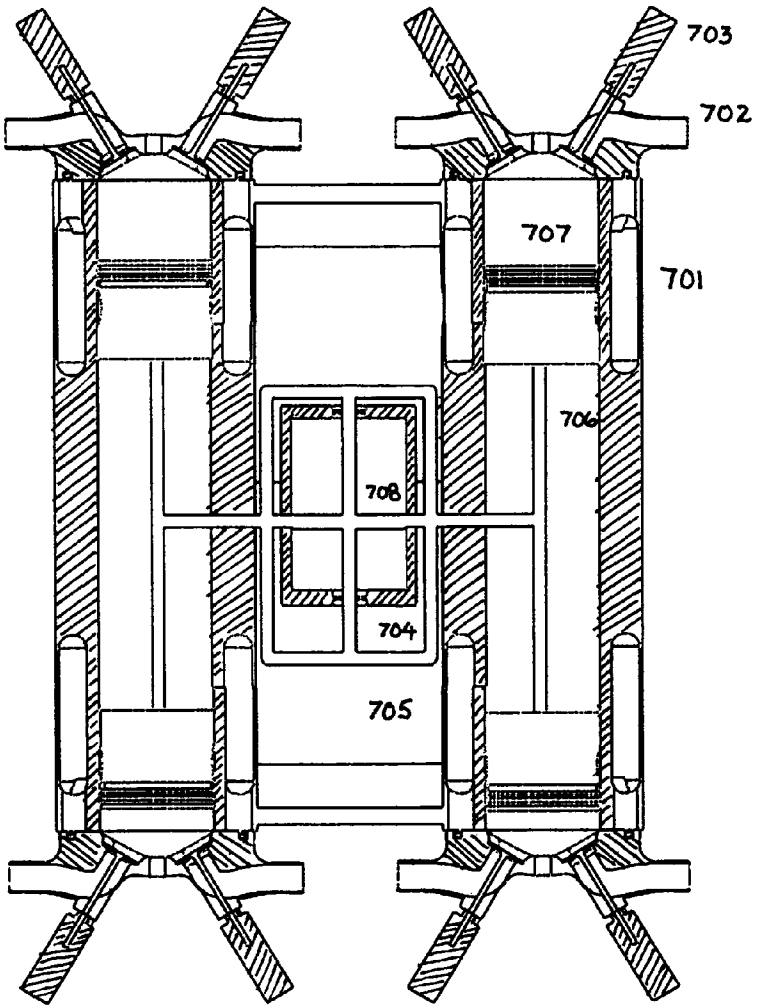
FIG. 7 shows a section of the cylinder of the four-cylinder design in FIG. 6.

Turning to FIG. 7, a section view of the four-cylinder design is shown. The combustion cylinders 701 are in an H-pattern. The hydraulic cylinder 704 has a piston 708 that moves up and down as fluid is injected or released from the cylinder. The piston has a connecting rod cage in an H-patter that inserts into each cylinder and attaches to each piston 707.

Figure 8:
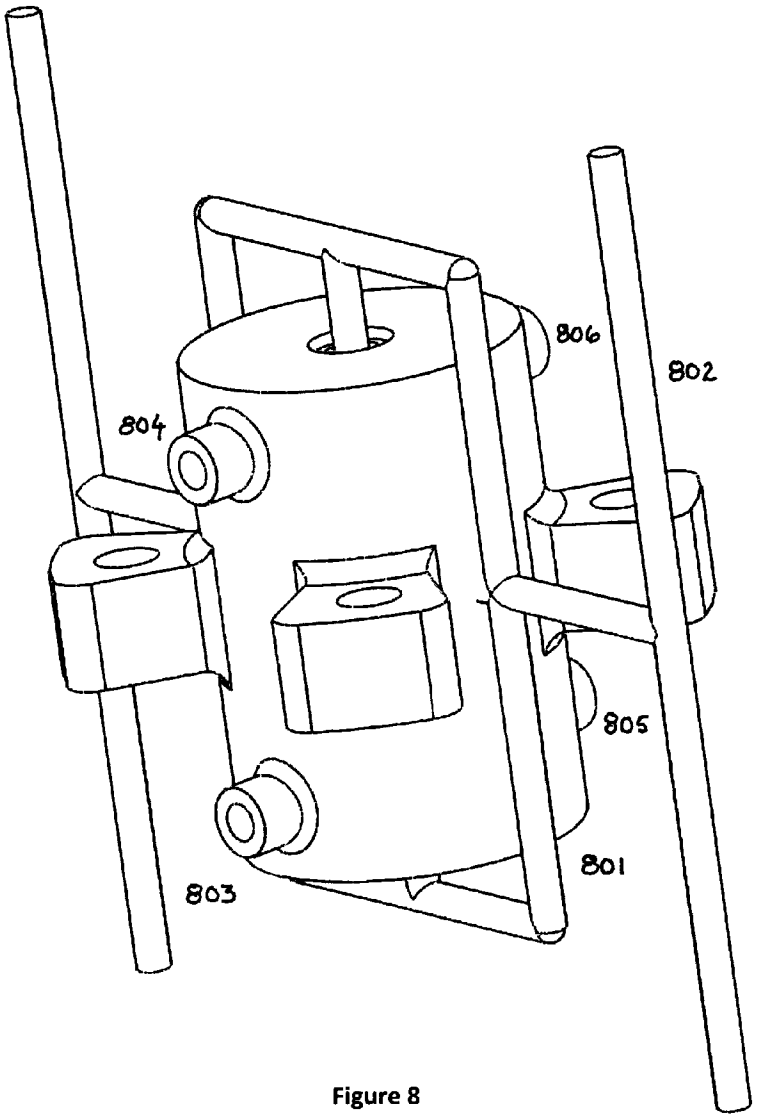
FIG. 8 shows the hydraulic cylinder used in the embodiment of FIG. 6.

Turning to FIG. 8, the hydraulic cylinder of the four-cylinder design is shown. The piston/connecting rod cage 802 is shown inside the hydraulic cylinder 801. Four fluid inlets and outlets are shown, 803, 804, 805, and 806. Two of the inlets may be used to inject fluid to move the piston 802 upwards or downwards, as fluid fills the top or bottom volume of the cylinder. Two of the outlets may be used to expel pressurized fluid from the top of bottom volume in the cylinder as the piston is pushed upwards or downwards.

The features and advantages described herein are all optional and not necessarily required in any particular embodiment. In addition, the various features and advantages could be combined in various configurations to form a wide variety of embodiments with a variety of goals and trade-offs. In particular, a non-limiting list of optional features and configurations include: electrohydraulic valves may or may not be used in an embodiment; the system may be adapted to use multiple fuels—either in calibration and piston/valve events (such as gas, propane, and ethanol, for example) or further by adapting the hardware and calibration (for diesel, HCCI, a single fuel, etc.); the system control calibration can be adapted to run various thermodynamic cycles, including ideal cycles, a single standard cycle, and combined cycles; the system can optionally use boosting, supercharging, turbocharging, or supercharging without a belt system; the system can be combined with a motor (such as an ISG, but not limited to that) for hybrid operation; the hydraulic power unit can be a single fluid turbine, or can optionally include an ISG and/or a supercharger; these units can operate with a single shaft or can be clutched to each other; the clutches may be variable speed; the output of the system can be shaft work via a shaft or can be electrical power from the ISG unit, or both; if electrical, the system could power remote electric motors; the system could incorporate any hydraulic actuator known in the art, or any combination of actuators in compound fluid circuits; it may be possible to configure the individual power cylinder units so that any number can be used, removed, or used in various configurations by linking them hydraulically or removing them from the system.

In other embodiments, it may be possible to use an optional ISG to control the speed of the system. Alternatively, the engine and hydraulic system may operate at a constant speed, while the speed of the ultimate load being powered (or output shaft) is controlled solely by the load on the ISG. It may be further possible to put an ISG load on the system to control the ultimate speed/load of the system while using extra power to store charge in batteries. It may be possible to do this while the engine/hydraulic system operates at a constant speed. There are numerous other ways to implement the hybrid system/ISG that are known in the art and do not deviate from the spirit of this invention. The system may also require fluid pressure transducers throughout various positions of the hydraulic system without varying from the spirit of this invention.

In yet other embodiments, the internal dimensions of the hydraulic cylinder, its internal shafting sizes, internal valving may be varied for various flow rates and pressures. These characteristics may be matched with the various characteristics of the fluid turbine for various goals. The system may also be matched with various pumps to meet other goals. In another embodiment, it may be desirable to size the flow rates, pressures, and dimensions of the various components to accommodate a various number of power cells and hydraulic cylinders.

Some of the objectives and advantages of the embodiments disclosed may be: to gain thermodynamic efficiency, to increase design flexibility of the system, to offer a smaller unit that is easier to package, lower cost, lower weight, or other advantages. Various configurations of the above embodiments may be designed to achieve one or more of these advantages.

It is, therefore, apparent that there is provided in accordance with the present invention, systems and methods for managing the delivery of items to threat scanning machines. While this invention has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this invention.

What is claimed is:

1. A powertrain system, comprising:

at least one combustion cylinder, at least one cylinder head attached to an end of the combustion cylinder, at least one piston inside the combustion cylinder, such that a combustion chamber is formed in the volume between the piston, combustion cylinder, and cylinder head, at least one hydraulic motion device mechanically connected to the lower surface of the piston, such that motion of the piston due to pressure in the combustion chamber creates motion in the hydraulic motion device, fluid in communication with the hydraulic motion device, such that the motion in the hydraulic motion device creates momentum in the fluid, and a fluid power device in communication with the fluid.

2. The powertrain system of claim 1, wherein the fluid power device is a fluid turbine.

3. The powertrain system of claim 1, wherein the hydraulic motion device is a hydraulic cylinder.

4. The powertrain system of claim 1, wherein the hydraulic motion device is a hydraulic rotary actuator.

5. The powertrain system of claim 1, further comprising:

at least one hydraulic valve that controls an entry of the fluid into at least one hydraulic motion device, and at least one hydraulic valve that controls an exit of the fluid from at least one hydraulic motion device.

6. The powertrain system of claim 5, further comprising a low pressure fluid circuit and a high pressure fluid circuit.

7. The powertrain system of claim 6, wherein a hydraulic motion device in the low pressure circuit is used to raise the piston and a hydraulic motion device in the high pressure circuit is acted upon by a falling piston.

8. The powertrain system of claim 6, further comprising:

at least one hydraulic valve that controls the communication of the fluid with the hydraulic motion device, such that the movement of the hydraulic motion device corresponds to the cycles of the internal combustion engine.

9. The powertrain system of claim 1, further comprising:

an electronic control system that controls the operation of the internal combustion engine and the function of the hydraulic motion device, and at least one sensor used to sense the position of at least one piston for feedback control of the motion of at least one piston.

10. The powertrain system of claim 1, further comprising:

an electro hydraulic valvetrain subsystem attached to the cylinder head.

11. The powertrain system of claim 1, further comprising a hybrid-electric system attached to the fluid power device.

12. The powertrain system of claim 11, wherein the hybrid-electric system is comprised of:

an integrated starter-generator, and at least one battery.

13. The powertrain system of claim 1, wherein the fluid that is input into a hydraulic cylinder is used to raise the piston against the combustion chamber, such that downward motion of the piston is used to expel fluid out of a hydraulic cylinder.

14. The powertrain system of claim 6, wherein the fluid that is input into a hydraulic cylinder is used to raise the piston against the combustion chamber, such that downward motion of the piston is used to expel fluid out of a hydraulic cylinder.

15. The powertrain system of claim 8, wherein the fluid that is input into a hydraulic cylinder is used to raise the piston against the combustion chamber, such that downward motion of the piston is used to expel fluid out of a hydraulic cylinder.

16. The powertrain system of claim 1, wherein the fluid expelled from the outlet of the fluid power device is used as the fluid that is input into the hydraulic cylinder to raise the piston.

17. The powertrain system of claim 7, further comprising a plurality of hydraulic valves, such that one hydraulic valve is opened to allow the fluid that in input into the hydraulic cylinder to raise the piston and another hydraulic valve is opened to allow the fluid that is expelled to the input to the fluid power device to exit the hydraulic cylinder.

18. The powertrain system of claim 8, further comprising a plurality of hydraulic valves, such that one hydraulic valve is opened to allow the fluid that in input into the hydraulic cylinder to raise the piston and another hydraulic valve is opened to allow the fluid that is expelled to the input to the fluid power device to exit the hydraulic cylinder.

19. The powertrain system of claim 1, further comprising:

at least two pistons, and at least two combustion chambers, such that the pressure in at least one combustion chamber creates motion in at least one piston, and the motion of the at least one piston is used to move at least one other piston and compress the gas in at least one other combustion chamber;

wherein the pistons and the fluid power device are sized appropriately such that the pressure of the fluid expelled from the outlet of the fluid power device is sufficient to compress the gas in at least one combustion chamber.

20. The powertrain system of claim 19, wherein the engine has four cylinders in a horizontally opposed H-pattern, such that the momentum of the power stroke of one piston is always used to assist with the compression stroke of an opposing piston.

* * * * *